US005775895A

United States Patent [19]

Fenn et al.

[11] Patent Number: 5,775,895

[45] Date of Patent: Jul. 7, 1998

[54] COMBUSTION-STATE DETECTING CIRCUIT OF COMBUSTION APPARATUS

[75] Inventors: Gordon William Fenn, Brevard, N.C.; Young Moon Ryoo, Ansan; Hong Jib Kim, Incheon, both of Rep. of Korea

[73] Assignee: Haitai Electronics Co., Ltd., Incheon, Rep. of Korea

[21] Appl. No.: 745,702

[22] Filed: Nov. 12, 1996

[30] Foreign Application Priority Data

Nov. 20, 1995 [KR] Rep. of Korea ..... 95-42315

[51] Int. Cl.[6] ..... F23N 5/00

[52] U.S. Cl. ..... 431/66; 431/25; 340/579

[58] Field of Search ..... 431/25, 66; 340/579, 340/577

[56] References Cited

U.S. PATENT DOCUMENTS 5,049,063 9/1991 Kishida et al. ..... 431/25
5,073,104 12/1991 Kemio ..... 431/25
5,503,183 4/1996 Fenn et al. ..... 137/597
5,526,776 6/1996 Fenn et al. ..... 122/367.3
5,548,277 8/1996 Wild ..... 340/579

*Primary Examiner*—Carroll B. Dority
*Attorney, Agent, or Firm*—Dougherty & Dremann

[57] ABSTRACT

There is disclosed a combustion-state detecting circuit of a combustion apparatus installed in a combustion chamber, including: a flame detector that has a heat-emitting device for emitting heat on application of an alternating current signal, and produces a potential difference between the current applied to the heat-emitting device and flame-electric current produced by ignition occurring within the combustion chamber; a rectifier that changes the alternating current signal provided by the flame detector into a direct current signal; an inversion amplifier that inverts the direct current signal produced by the rectifier with respect to a reference signal and increases the magnitude of the inverted signal; and a flame discriminator that compares the output signal of the inversion amplifier with a flame discriminating reference signal to determine if ignition occurs.

1 Claim, 2 Drawing Sheets

COMBUSTION-STATE DETECTING CIRCUIT OF COMBUSTION APPARATUS

BACKGROUND OF THE INVENTION

The present invention relates to a combustion-state detecting circuit of a combustion apparatus and, more particularly, to such a combustion-state detecting circuit of a combustion apparatus that employs a heat-emitting device as an igniter of the combustion apparatus, and senses if ignition happens according to a flame-electric current provided from the heat-emitting device and detects the actual state of combustion occurring within the combustion chamber.

A combustion apparatus that causes gas to burn to produce heat is generally included in a boiler, an instant hot-water supply equipment and the like. The heat produced by the combustion apparatus is used to heat up water for a hot-water boiler or a hot-water supply system. A conventional combustion apparatus includes as an igniter, an ignition plug that uses sparks of high-voltage current, and a flame detector that detects if ignition occurs by means of the produced flame-electric current. Such a conventional combustion apparatus ignites gas by using the ignition plug, and determines if ignition occurs by the flame detector. The ignition plug operates until a flame detecting signal is generated by the flame detector. The flame detector senses if ignition occurs by using flame-electric current generated with the combustion of gas.

The conventional combustion apparatus allows ignition to occur by using the ignition plug and the flame detector, and employs the flame detector to sense if the ignition occurs. In the conventional combustion apparatus, two parts, the ignition plug and the flame detector, are assembled as an ignition means, which causes an increase in the number of the fabricating steps and the time required for the fabrication. Besides, the actual state of combustion within the combustion chamber cannot be detected by the conventional combustion apparatus.

SUMMARY OF THE INVENTION

Accordingly, the present invention relates to a combustion-state detecting circuit of a combustion apparatus that substantially obviates one or more of the problems due to limitations and disadvantages of the related art. It is an object of the present invention to provide a combustion-state detecting circuit of a combustion apparatus that employs a simple igniter and a simple flame detector and detects the actual state of combustion within a combustion chamber for the purpose of sensing if the amount of gas and air provided thereto is adequate.

To achieve these and other advantages and in accordance with the purpose of the present invention, as embodied and broadly described, the combustion-state detecting circuit of the present invention installed in a combustion chamber, includes a flame detector that has a heat-emitting device for emitting heat on application of an alternating current signal, and produces a potential difference between the current applied to the heat-emitting device and flame-electric current produced by ignition occurring within the combustion chamber; a rectifier that changes the alternating current signal provided from the flame detector into a direct current signal; an inversion amplifier that inverts the direct current signal produced from the rectifier with respect to a reference signal and increases the magnitude of the inverted signal; and a flame discriminator that compares the signal produced from the inversion amplifier with a flame discriminating reference signal to determine if ignition occurs.

BRIEF DESCRIPTION OF THE ATTACHED DRAWINGS

DESCRIPTION OF PREFERRED EMBODIMENT

A preferred embodiment of the present invention is now described in detail with reference to the accompanying drawings.

Figure 1:
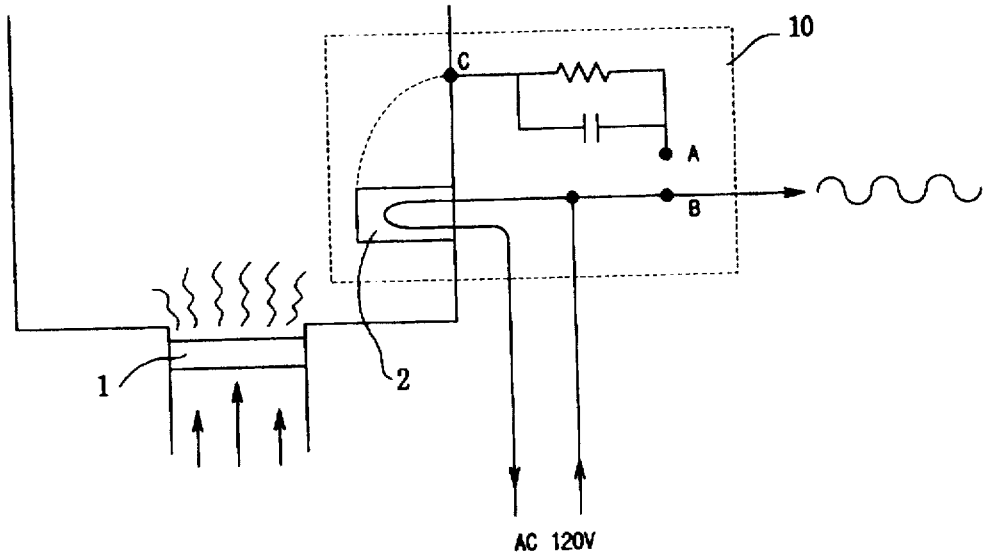
FIG. 1 is a schematic diagram of a flame detector installed in a combustion apparatus in accordance with the present invention.
Figure 3:
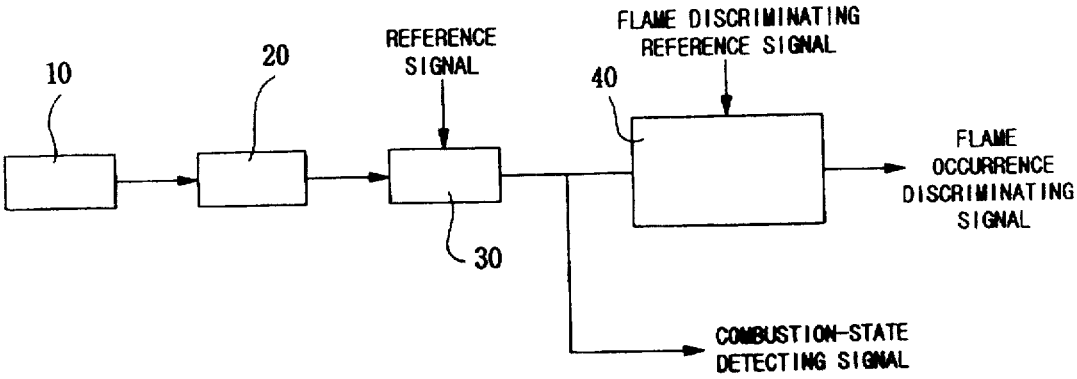
FIG. 3 is a block diagram of the combustion-state detecting circuit of a combustion apparatus in accordance with the present invention.
Figure 2:
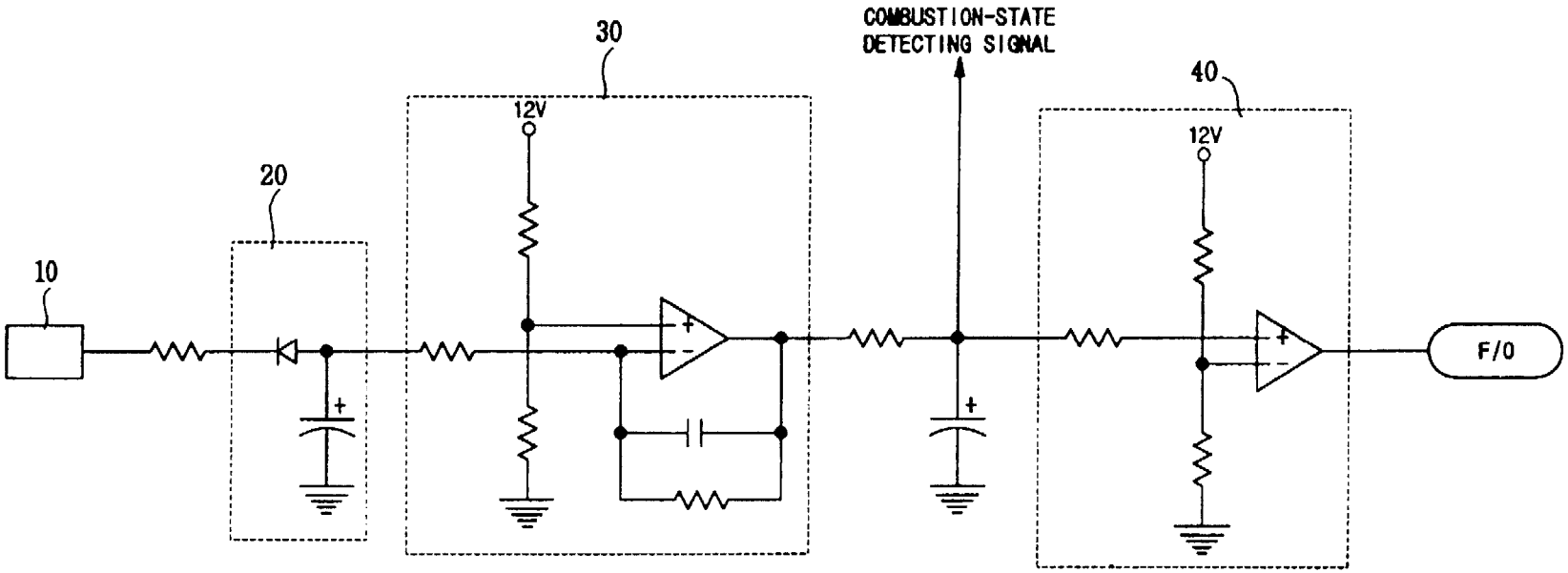
FIG. 2 is a circuit diagram of a combustion-state detecting circuit of a combustion apparatus in accordance with the present invention.

FIG. 1 is a schematic diagram of a combustion apparatus and a flame detector in accordance with the present invention, and FIG. 2 is a circuit diagram of a combustion-state detecting circuit of a combustion apparatus in accordance with the present invention. FIG. 3 is a block diagram of the inventive combustion-state detecting circuit of a combustion apparatus.

As shown in the drawing, the inventive combustion-state detecting circuit of a combustion apparatus is installed in a combustion chamber, and includes a flame detector 10 that has a heat-emitting device 2 for emitting heat on application of alternating current, and produces a potential difference between the current applied to the heat-emitting device 2 and flame-electric current produced by ignition occurring within the combustion chamber, and a rectifier 20 that changes the alternating current (AC) signal produced by the flame detector into a direct current (DC) signal. The inventive combustion-state detecting circuit also includes an inversion amplifier 30 that inverts the DC signal produced from the rectifier 20 with respect to a reference signal and increases the magnitude of the inverted signal, and a flame discriminator 40 that compares the signal produced from the inversion amplifier 30 with a flame discriminating reference signal to determine if ignition occurs.

The heat-emitting device 2 comes to emit heat on application of alternating current and also serves as an igniter that ignites gas. As the gas existing in the combustion chamber ignites and starts to burn up, flame-electric current flows into C of FIG. 1 from the heat-emitting device 2 by the flame, and the stronger the flame becomes, the more the intensity of the flame-electric current is increased.

When the flame-electric current is generated, the alternating current that occurs by a potential difference between A and B of FIG. 1 is lower than the current applied to the heat-emitting device 2. Accordingly, the stronger the flame becomes, the more the intensity of the alternating current produced from the flame detector 10 is decreased.

The following description concerns the operation of the inventive combustion-state detecting circuit of a combustion apparatus.

When ignition of the combustion apparatus starts, alternating current flows into the heat-emitting device 2 of the flame detector 10, and the heat-emitting device 2 produces heat to ignite gas. As combustion begins and continues in the combustion chamber, flame-electric current occurs by a flame. The flame-electric current causes the flame detector 10 to produce alternating current whose intensity is lower than that of the applied alternating current.

The rectifier 20 changes the alternating current produced by the flame detector 10 to direct current. The inversion amplifier 30 increases the magnitude of the DC signal produced by the rectifier 20, and inverts the DC signal with respect to a reference signal and outputs the inverted signal.

The better the state of combustion is, the lower the level of the DC signal produced from the rectifier 20 becomes, and the higher the level of the DC signal produced by the amplifier 30 becomes.

The flame discriminator 40 compares the DC signal produced from the inversion amplifier 30 with a flame discriminating reference signal to determine if a flame occurs. When the DC signal produced from the inversion amplifier 30 is higher in level than the flame discriminating reference signal, the flame discriminator 40 determines that the combustion begins and continues within the combustion chamber and, on the contrary, when the DC signal produced by the inversion amplifier 30 is lower in level than the flame discriminating reference signal, the flame discriminator 40 determines that combustion does not occur within the combustion chamber.

As mentioned above, the inventive combustion-state detecting circuit can determine if a flame occurs or not, according to an output signal of the flame discriminator 40. Moreover, this combustion-state detecting circuit can detect the state of combustion that occurs within the combustion chamber, according to a DC signal produced by the inversion amplifier 30.

The intensity of flame-electric current is high when the magnitude of the DC signal produced from the inversion amplifier 30 is large, which indicates that the combustion continues strongly in the combustion chamber. On the contrary, the intensity of flame-electric current becomes low when the magnitude of the DC signal produced from the inversion amplifier 30 is small, which indicates that the combustion is in a weak state. The state of combustion within the combustion apparatus can be determined by a level of the output DC signal of the inversion amplifier 30. The DC signal produced by the inversion amplifier 30 may serve as a control signal of a gas valve for supplying gas to the combustion chamber and an exhaust fan for supplying air to the combustion chamber.

The combustion-state detecting circuit of a combustion apparatus in accordance with the present invention has the functions of igniting gas, determining if a flame exists (if ignition occurs) and determining the state of combustion.

The present invention can simplify the construction of means for ignition and flame detection and can determine the occurrence of a flame just with the heat-emitting device 2 installed in the combustion chamber. Thus, by using the combustion-state detecting circuit, the actual state of combustion within the combustion chamber can be detected for the purpose of controlling the gas valve and the exhaust fan and gaining optimal control over the state of combustion of the combustion apparatus. In other words, when the combustion-state detecting signal generated by the inversion amplifier 30 is higher in level than the combustion discriminating reference signal, a large amount of gas and air is provided to the combustion chamber, and when the combustion-state detecting signal generated by the inversion amplifier 30 is lower in level than the combustion discriminating reference signal, a small amount of gas and air is provided to the combustion chamber in such a manner that the state of combustion occurring within the combustion chamber can be controlled to an optimum point with the comparison of the signals.

Therefore, it should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A combustion-state detecting circuit of a combustion apparatus installed in a combustion chamber, comprising:

a flame detector having a heat-emitting device for emitting heat on application of an alternating current signal and producing a flame detector alternating current signal;

a rectifier connected to said flame detector for receiving the flame detector alternating current signal from said flame detector and converting said flame detector alternating current signal to a direct current signal;

an inversion amplifier connected to said rectifier for receiving the direct current signal from said rectifier, inverting the received direct current signal based on a reference signal and amplifying the inverted direct current signal; and a flame discriminator/comparitor connected to said inversion amplifier, said flame discriminator/comparitor for receiving the amplified inverted direct current signal from said inversion amplifier and comparing the amplified inverted direct current signal with a flame discriminating reference signal to determine whether ignition occurs.

* * * * *